US008517163B2

(12) United States Patent
Quattrini et al.

(10) Patent No.: US 8,517,163 B2
(45) Date of Patent: Aug. 27, 2013

(54) COIN HANDLING SYSTEM FOR VALIDATION, SORTING, AND DISPENSING COINS

(75) Inventors: Victor A. Quattrini, Merrimac, MA (US); Robert Pitman, Beverly, MA (US); Paul Stump, Topsfield, MA (US); Jack J. Bisson, Groveland, MA (US); Jeff Janway, Manchester, NH (US); Hamlin Peterke, Exeter, NH (US); Don Stanley, Dracut, MA (US)

(73) Assignee: Telequip Corporation, Salem, NH (US)

( * ) Notice: Subject to any disclaimer, the term of this patent is extended or adjusted under 35 U.S.C. 154(b) by 554 days.

(21) Appl. No.: 11/461,815

(22) Filed: Aug. 2, 2006

(65) Prior Publication Data

US 2007/0029159 A1 Feb. 8, 2007

Related U.S. Application Data

(60) Provisional application No. 60/705,052, filed on Aug. 2, 2005.

(51) Int. Cl.
*G07D 7/00* (2006.01)

(52) U.S. Cl.
USPC ..... 194/302; 194/334; 194/338; 453/14; 453/57

(58) Field of Classification Search
USPC ..... 194/228, 234, 243, 249, 291, 294, 194/302, 310, 311, 338, 342, 343, 346; 453/14, 453/15; 209/655; 198/890, 890.1; 232/1 D, 232/44, 55, 57.5
See application file for complete search history.

(56) References Cited

U.S. PATENT DOCUMENTS

| | | | | |
|---|---|---|---|---|
| 3,590,833 | A | 7/1971 | Walton | |
| 4,228,812 | A * | 10/1980 | Marti | 453/5 |
| 4,558,711 | A | 12/1985 | Yoshiaki et al. | |
| 4,893,706 | A * | 1/1990 | Ibarrola | 194/346 |
| 5,356,332 | A | 10/1994 | Thompson et al. | |
| 5,366,407 | A | 11/1994 | Sentoku | |
| 5,390,776 | A | 2/1995 | Thompson | |
| 5,400,891 | A | 3/1995 | Winstanley | |
| 5,468,181 | A | 11/1995 | Ishida et al. | |
| 5,830,054 | A * | 11/1998 | Petri | 453/5 |
| 5,941,364 | A * | 8/1999 | Wei | 194/350 |
| 5,964,657 | A | 10/1999 | Abe et al. | |
| 6,171,182 | B1 * | 1/2001 | Geib et al. | 453/10 |
| 6,431,342 | B1 * | 8/2002 | Schwartz | 194/346 |
| 6,508,700 | B2 | 1/2003 | Mori et al. | |
| 6,640,956 | B1 | 11/2003 | Zwieg et al. | |
| 6,783,452 | B2 | 8/2004 | Hino et al. | |
| 6,868,955 | B2 * | 3/2005 | Mikami et al. | 194/350 |
| 6,899,214 | B2 | 5/2005 | Morikawa | |

(Continued)

OTHER PUBLICATIONS

International Search Report dated Jul. 31, 2007 from PCT Application No. PCT/US06/30131.

(Continued)

*Primary Examiner* — Jeffrey Shapiro

(57) ABSTRACT

A system for handling coins employs a front end coin acceptor and validator that feeds a sorter mechanism. The sorter mechanism utilizes a substantially horizontal track module to load coins by denomination into an arrangement of bins. The coins are ejected by means of a solenoid onto the track module that provides a path according to the denomination of the coin into the proper bin.

20 Claims, 7 Drawing Sheets

(56) References Cited

U.S. PATENT DOCUMENTS

| | | | | |
|---|---|---|---|---|
| 7,429,213 | B2 * | 9/2008 | Enomoto et al. | 453/57 |
| 2002/0060122 | A1 | 5/2002 | Mikami et al. | |
| 2002/0134645 | A1 | 9/2002 | Alexander et al. | |
| 2002/0189919 | A1 | 12/2002 | Abe | |
| 2003/0201146 | A1 | 10/2003 | Abe et al. | |
| 2004/0097182 | A1 * | 5/2004 | Hill et al. | 453/3 |
| 2004/0259490 | A1 * | 12/2004 | Hino et al. | 453/3 |
| 2005/0142998 | A1 * | 6/2005 | Enomoto et al. | 453/9 |
| 2007/0087675 | A1 | 4/2007 | Umeda et al. | |

OTHER PUBLICATIONS

Supplementary European Search Report dated Sep. 20, 2010 in connection with European Patent Application No. 06 78 9223.

* cited by examiner

COIN HANDLING SYSTEM FOR VALIDATION, SORTING, AND DISPENSING COINS

RELATED APPLICATION

This application claims the benefit of U.S. Provisional Application for Pat. No. 60/705,052, filed Aug. 2, 2005.

BACKGROUND OF THE INVENTION

1. Field of the Invention

The invention is related to systems for dispensing coins that use bin type storage for coin inventory. More specifically it relates to a system adapted to accept, validate, sort, and dispense coins.

2. Brief Description of Related Developments

Coin dispensers generally employ a canister for holding a supply of coins in various denominations. The coins are held in stacks within tubular receptacles constructed in the canisters. Each stack is made up of a different denomination of coin having different diameters. Filling the canisters is done manually in advance of the deployment of the dispenser and is periodically replenished as the coins are depleted. Since the tubular receptacles are designed for the physical shape of the coin, configurations of this type lack flexibility for accommodating different sets of coins. This has led to the use of bin style storage that employs an array of bins for storing coins in bulk. The coins are distributed by denomination, i.e. a bin for each denomination of coin used. Bin style storage is not restricted by the physical characteristics of the coin. Such coin storage systems facilitate storing, loading and unloading of coins in a coin handling system.

Many coin dispensers are employed in point of sale machines, such as vending machines, into which coins are inserted by a customer to obtain a product. Columnar type dispensers, although reliable and accurate, are limited in the recycling of the customer inserted coins into the dispenser, thus requiring separate storage and accounting.

Vending machines and other machines that accept coin payments and dispense change require a front end coin acceptor to validate the coin as legal tender and identify the denomination. The information provided by the acceptor can be used to sort and account for the inventory of coins in the machine. Acceptor systems of this type are manufactured by companies such as Mars Electronics Inc., National Rejectors Inc., Coin Acceptors, Inc. (also known as CoinCo) and others. The acceptor units are generally adapted to particular sorting mechanisms.

Prior art sorting mechanisms generally are passive systems that rely primarily on gravity to distribute the coin by denomination. The sorting is generally accomplished by rolling or transporting the coins over a series of openings in a rail or plate on which the openings are arranged by size from the smallest to the largest. The coins progress on the rail or plate until the coin falls through its proper hole. Such systems are again reliant on the physical size of the coin and require different designs depending on the coin set in the particular market place. In addition, these mechanisms are somewhat large and require a certain height through which gravity can exercise control.

A more active type of sorter may be adapted for use with an acceptor unit front end. After a coin is accepted and identified a series of gates are triggered to define a vertical path for the coin to drop to its respective bin. Although less reliant on coin shape, these system still use gravity and require a considerable amount of space, particularly height in which to operate.

It is a purpose of the embodiments described in this application to provide a reliable system for recycling coins in a combined system of coin handling that provides acceptance/validation, sorting and dispensing. This is accomplished by adapting the output of an acceptor unit to at least partially control a sorting mechanism that distributes accepted coins by denomination into a bin type storage system for dispensing. It is another purpose of the embodiments of this application to generate data in digital form for reliably accounting for coins passing through the coin handling system. It is another purpose of the embodiments of this application to construct a sorter mechanism that combines high reliability, active sorting with an overall sorter mechanism package having drastically reduced height, while providing the ability to deliver sorted coins to widely separated end points, namely the bins or hoppers of the coin storage system.

BRIEF SUMMARY OF THE INVENTION

In a first embodiment of the invention, a system for handling coins employs a front end coin acceptor and validator that feeds a sorter mechanism. The sorter mechanism utilizes a substantially horizontal assembly of tracks to load coins by denomination into an arrangement of bins. The coins are ejected, from a coin holder or pocket, by means of a solenoid, onto a selected track of an array of horizontal tracks, each of which provides a path, according to the denomination of the coin, into the proper bin. The coin pocket and striking solenoid are mounted for movement with respect to the horizontal tracks in response to identification of the denomination by the acceptor unit. A rack and pinion drive aligns the coin pocket with the opening of the proper track and the coin is forcibly ejected by a solenoid to travel down the track, to the assigned bin.

In another aspect of the invention, a coin of known denomination is deposited into a coin pocket via the validating acceptor and its position is confirmed via the coin present sensor. Based on the denomination, solenoid-actuated selector gates are configured to guide the coin along a substantially horizontal path to any one of several possible end-points coincident with a bin of the proper denomination. Once the gates are set the coin is then fired down the rail to its end point by the coin striking solenoid.

In another aspect of this invention an arrangement of hopper dispensers (bins) are assembled on a removable chassis wherein each bin is attached by a hinge that provides a horizontal pivot axis. This allows the hopper bins to tilt individually in order to facilitate unloading of the coins.

In another aspect of this invention a control system is constructed to track the coins along the various paths, monitor the condition of the bins, and generate the data needed to provide accounting for the coins traversing the system.

In another aspect of this invention a sorter is constructed having a default path which directs coins to a common bin for storage. Coins from the common bin are not recycled. They are not part of the dispensing inventory. System logic provides for active distribution of coins once accepted and identified as long as the sorting system is operative and the storage bins are available.

Another aspect of the invention involves a control algorithm that utilizes the default path. After a coin is inserted by a customer, the acceptor checks to determine if it is valid currency and if it is identifies the denomination. If the coin is rejected, the acceptor guides it directly to the coin return, otherwise it is diverted to the sorter. The system checks to determine if the sorter is functional. If the sorter is out of order the coin is sent to a common bin regardless of denomination.

If the sorter is operational, the denomination is checked to see if the dispenser supports the currency, if not then it is sent to the common bin, if it is, the hopper capacity is checked to determine if it can receive more coins. Again if the bin is full, then the coin is sent to the common bin, but if the bin is able to accept more coins, then the coin is directed to the appropriate bin for use as dispensing inventory. Although the above steps are described sequentially, the decisions can be made in any order or simultaneously within the sorter.

It is another purpose of this invention to provide a rapid and convenient means for emptying or removing the coin inventory from the coin storage bins. The prior state of the art for removing coin inventory from bin-type dispensing mechanisms in both coin dispensers and coin recyclers is to mechanically run the coin out through the mechanism to the coin output cup one by one. This approach is tedious, inconvenient, stressful on the dispensing mechanism and time intensive. There are two primary reasons for emptying the coin inventory. The first is to perform a physical audit of the coin inventory, the second is in the event of a coin jam or failure internal to the dispensing mechanism to facilitate trouble-shooting and repair. In one embodiment a bin is constructed to receive and store coins. A support member, such as a plate or other structure, is constructed to support the bin. The bin is connected to the support member by a hinge. This allows the bin to pivot on the hinge and permits permit dumping of the bin contents while attached to the support member. This hinged construction can be applied to a single bin or multiple bins mounted on a chassis.

In another aspect of an embodiment of this application, multiple coin bins are mounted to a common chassis via a hinged plate that provides an axis of rotation, through which the coin bin can be tilted, to conveniently dump the contents for purposes of audit and repair. This aspect is significant in that it avoids the otherwise common practice of having to physically remove the coin bins to empty the contents for service access. By captivating or retaining the bins with a hinged attachment, the risks are avoided that are associated with; vulnerability of the bin mechanism to being dropped or otherwise subject to abuse when removed from the system. In this manner, the necessity to physically key each bin to it's proper location, and the cost and inherent reliability issues associated with providing an appropriate multi-pin connection associated with each individual bin are avoided.

BRIEF DESCRIPTION OF THE DRAWINGS

The coin handling system of this application is explained in more detail below with reference to the accompanying drawing, in which.

DESCRIPTION OF THE PREFERRED EMBODIMENT

Figure 1:
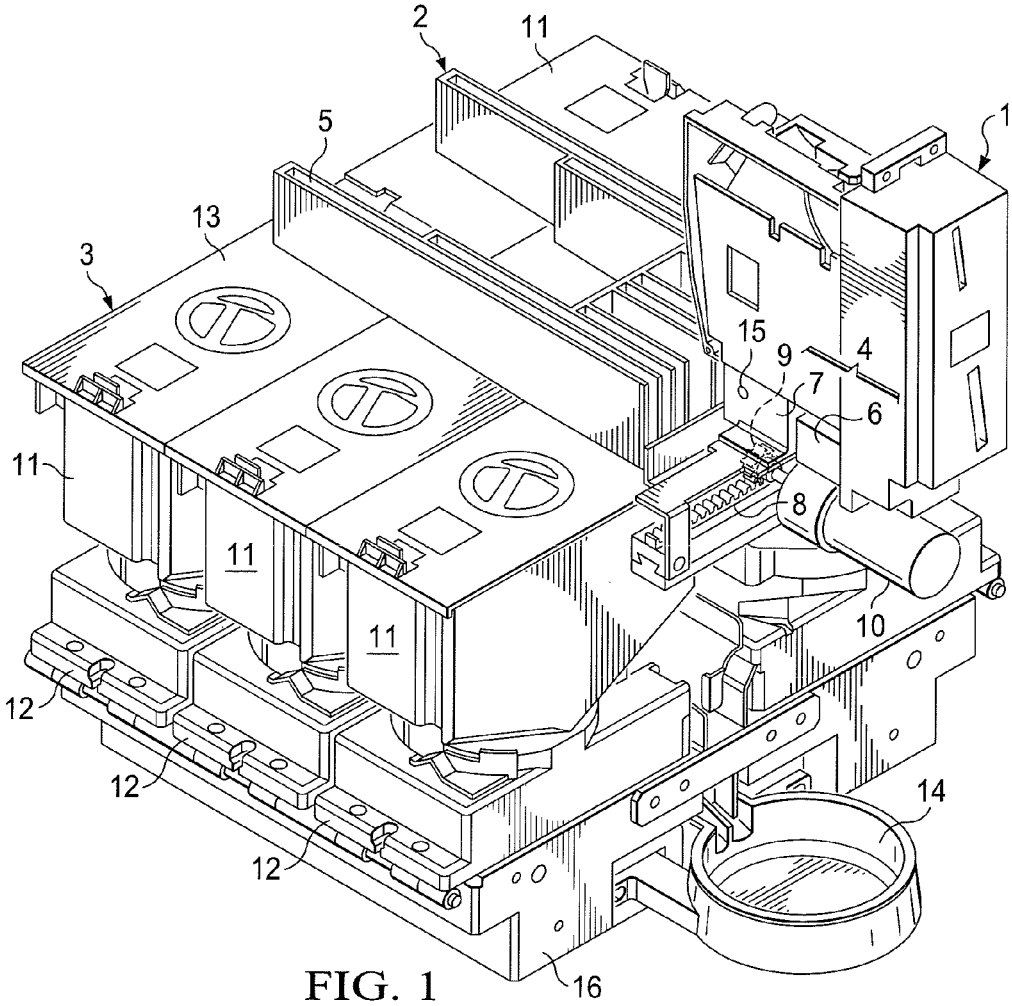
FIG. 1 is a perspective view of an embodiment of a coin handling system constructed according to this application.

A coin handling system, for accepting, sorting, and dispensing coins incorporating features of the present invention is illustrated in the figures. Although the present invention will be described with reference to the embodiments shown in the drawings, it should be understood that the present invention may have many alternate forms. In addition, any suitable size, shape or type of elements or materials could be used.

As shown in FIG. 1 the coin handling system of this invention has a front end coin acceptor unit 1 which receives coins from a customer and determines whether or not the coin is legal tender and if it is, the coins denomination is identified. The acceptor unit 1 generates signals reflecting the denomination. The acceptor unit 1 has two mechanical output paths, one in which a rejected coin will be directed to the coin return slot 14 and a second in which the coin is inserted into a coin pocket 7. Coin pocket 7 comprises a chamber that receives an accepted coin for firing outward by the action of a solenoid 6. A sensor 15 detects the presence of a coin in the pocket to start a sequence of events prior to firing the coin.

The coin pocket 7 provides the actuator for sorter unit 2 and is selectively aligned with a track of module 5 for transporting coins to a particular one of the bins 11. The track module 5 of sorter unit 2 comprises a series of tracks constructed to direct fired coins from the coin pocket to the desired bin. The ejector head 4, consisting of coin pocket 7 and striking solenoid 6, is mounted for movement, in the direction of arrow 20 in FIG. 4. After each coin firing, the ejector head 4 is returned to alignment with the output of acceptor 2. Track module 5 is mounted on chassis 16.

Movement of the ejector head 4 is provided by a rack and pinion drive 8, 9. Rack 8 engages pinion gear 9 to provide movement of the ejector head 4 relative to the openings at the entrance to the track module 5. Gear 9 is driven by a motor 10, in response to the coin denomination signal of acceptor unit 1. The bins 11 are arranged according to denomination and the coin pocket 7 is moved into alignment with the appropriate track of module 5 to receive a fired coin and direct it to the input opening 18 of the proper bin 11. Each of the tracks 5 is associated with one of the openings 18 of a particular bin 11. An additional bin (not shown), that may be positioned in the space between the dispensing hoppers, is identified as a common bin which is the default destination of coins of any denomination in the event of a malfunction of the system.

Figure 2:
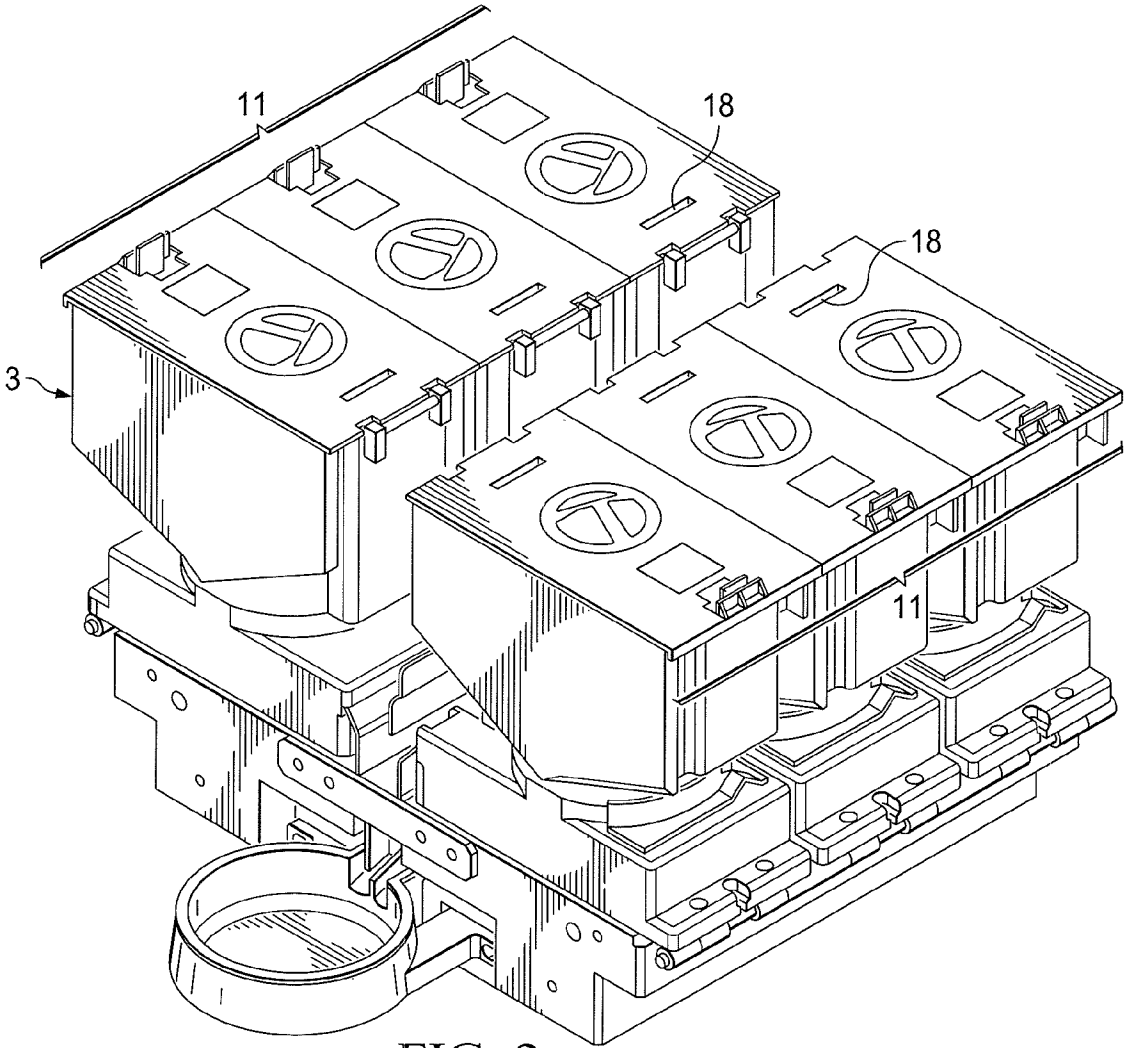
FIG. 2 is a perspective view of the coin storage and dispensing apparatus of the embodiment of FIG. 1.
Figure 3:
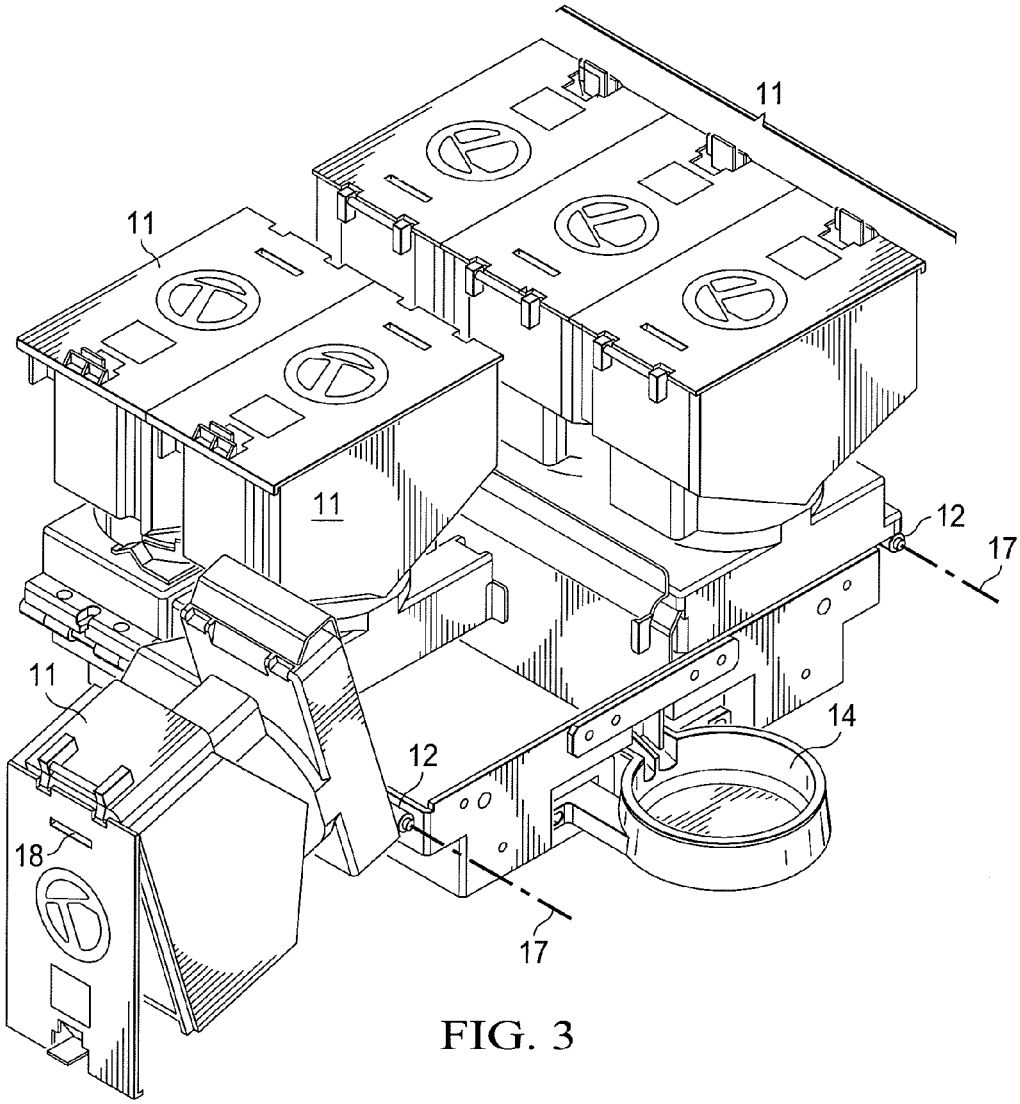
FIG. 3 is a perspective view of the coin storage and dispensing apparatus of FIG. 2, showing the dumping position.

Coin inventory storage and dispensing unit 3 is constructed having an individual or a series of bins 11 mounted on a chassis 16, as shown in FIGS. 2 and 3. Each of the bins is mounted on a hinge 12 that allows pivotal movement of each bin, about an axis 17, as shown in FIG. 3 to facilitate removal of the coins. An input opening 18 provides access for coins distributed to a bin 11 by an associated track 5. The storage and dispensing unit 3 on chassis 16 may be slidably mounted within a host device such as a self check-out machine (not shown). The chassis 16 is slid forward from the host device to expose the coin bins 11. This facilitates dumping or removal of the coin inventory for purposes such as audit or repair and troubleshooting.

Figure 4:
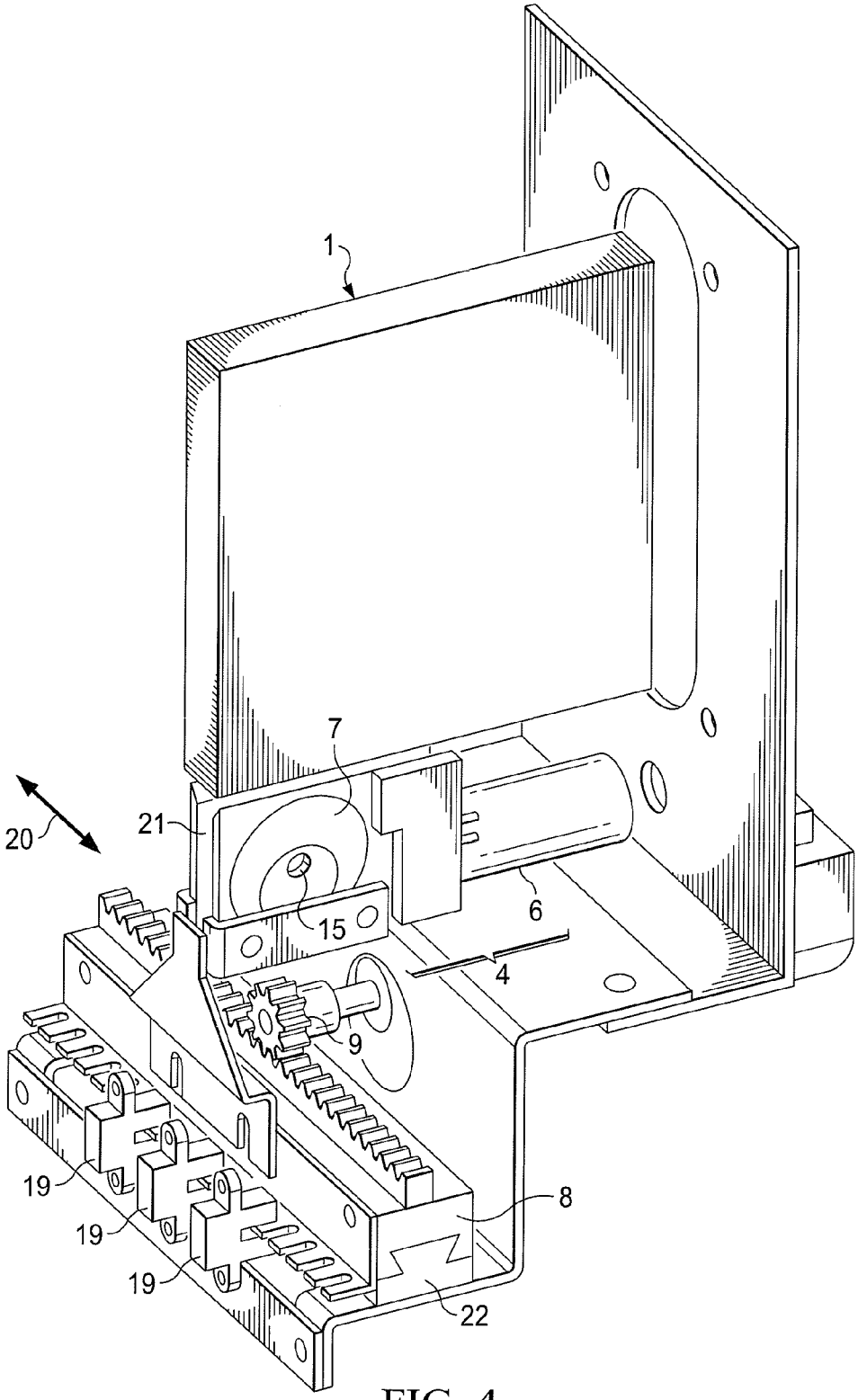
FIG. 4 is a perspective view of the front end of the coin handling system of FIG. 1.

The preferred embodiment of the front end of the coin handling system of this invention is shown in FIG. 4. The acceptor unit 1 feeds rejected coins to the coin return 14. Validated coins are fed directly to coin pocket 7. Coin pocket 7 consists of a chamber aligned with a striker solenoid 6. When the solenoid 6 fires, it strikes the coin, forcibly ejecting the coin from the chamber of coin pocket 7 to the aligned track of module 5. A sensor 15 detects the presence of a coin in the coin pocket chamber.

As described above, the ejector head 4 is mounted for movement as shown by arrow 20 in FIG. 4. This movement serves to align the outlet 21 of coin pocket 7 with the input to one of the tracks 5, according to denomination. A default location of coin pocket 7 aligns it with a track of module 5 that is adapted to direct the coin to a common bin. Movement of the ejector head 4 is driven by the operative cooperation of driven pinion gear 9 and rack 8. Rack 8 is mounted on a slide 22 for movement and ejector head 4 moves with the rack 8. Encoders 19 keep track of the position of the rack and generate signals that are fed back to a main controller for the sorter unit 2. Rack or coin pocket position is correlated to coin denomination according to an algorithm that directs the processors 51 of controller 50. The algorithm may be stored in memory 52.

Figure 5:
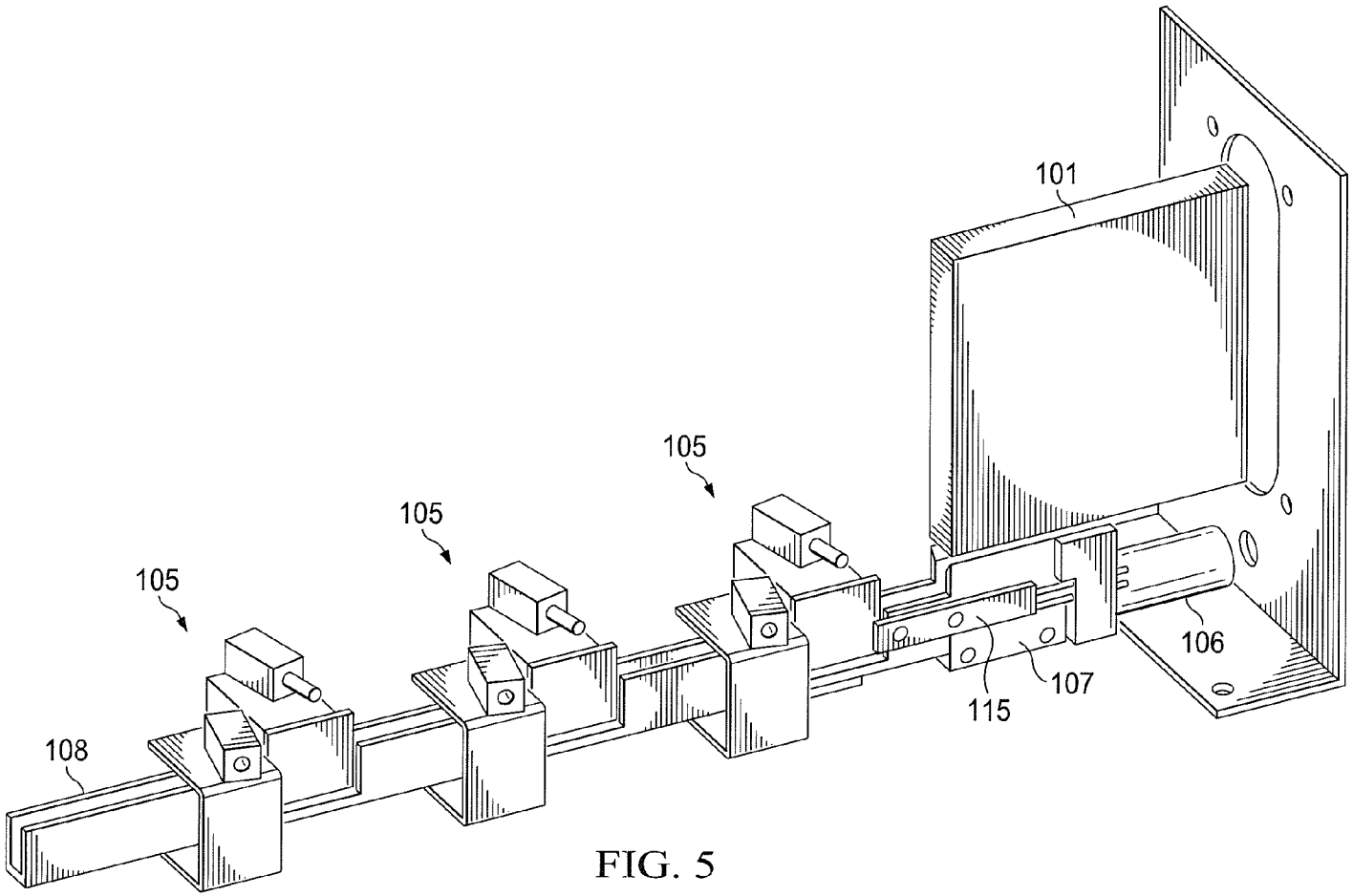
FIG. 5 is a perspective view of the front end of an alternate embodiment of the system of FIG. 1.

In an alternate embodiment, shown in FIG. 5, a single coin rail 108 is mounted in alignment with coin pocket 107. Coin rail 108 extends outward horizontally to reach the input gratings 18 of bins 11. A series of gates 105 are arranged to selectively deflect coins traveling on rail 108 to the proper grating 18 according to denomination. One of the gates 105 is deployed as a default to direct the coin to a common bin. The gates 105 are individually deployed into the path of the coins on rail 108 by solenoids 109. Solenoids 109 may be actuated according to signals from controller 50 relating to denomination identified by acceptor unit 1.

Figure 6:
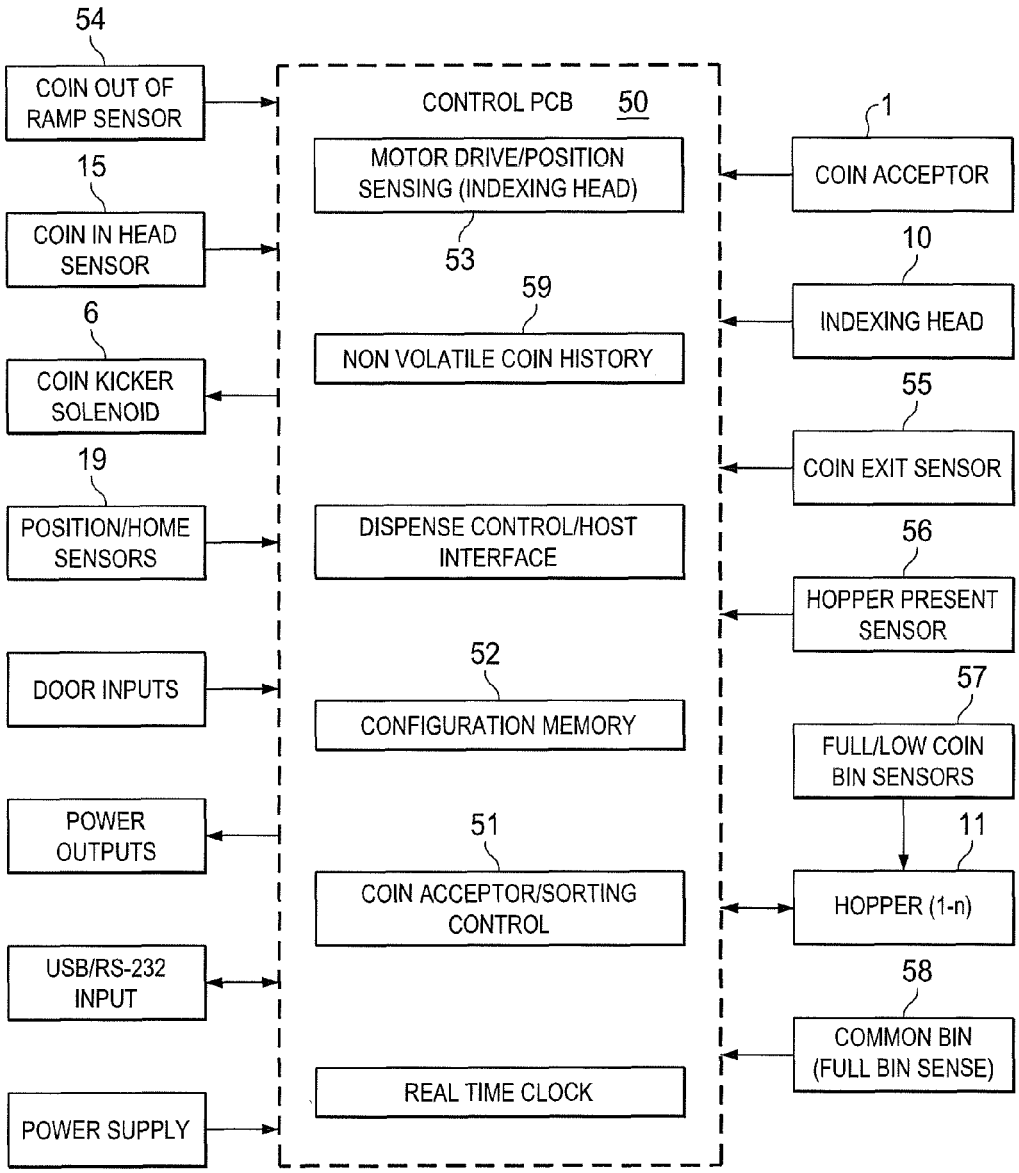
FIG. 6 is a block diagram of a control system for use in the embodiment of FIG. 1.

A control system for directing the operation of the sorter unit 2 is shown in FIG. 6. A series of computer elements, such as processors, clock timers, memory, bus elements, etc. are mounted on a printed circuit board in operative association to provide the function of a main controller 50. An algorithm may be stored in memory 52 to direct sorter operation processor 51. Position drive processor 53 operates the track module drive motor 10 according to position data received from encoders 19 and correlated to denomination by a track module position algorithm. The track module position algorithm may be a look up table that relates position to denomination. The above mentioned computer elements may be implemented in a variety of ways, for example, by individual components or combined as an ASIC chip, etc. A series of sensors 54-58, located throughout the sorter unit 2, storage unit 3, and dispenser 4, provide data to controller 50 with respect to the travel of a coin and the condition of the system. Accounting data relating to overall coin inventory, including coins recycled, originally loaded, and those dispensed is recorded in non-volatile history memory and processor 59.

Figure 7:
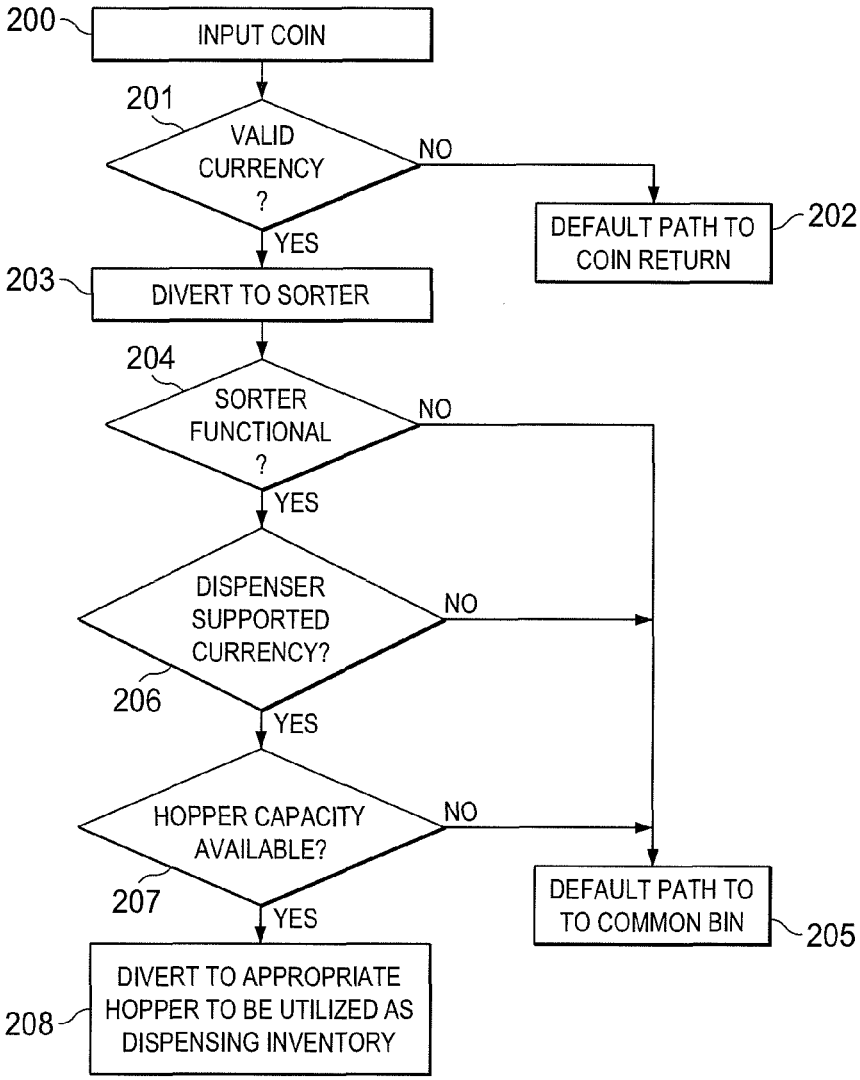
FIG. 7 is a flow diagram showing the sequence of operation the embodiment of FIG. 1.

In operation as illustrated in FIG. 7, after a coin is inserted by a customer at step 200, the acceptor checks to determine if it is valid currency (201) and if it is, the acceptor validates the coin and identifies the denomination. If the coin is rejected in step 201, the acceptor releases the coin to the return 14 (202). Accepted coins are diverted to the sorter in step 203 and the presence of a coin in coin pocket 7 is sensed. In step 204, the system checks to determine if the sorter is functional by querying sensors, such as sensors 56-58 relating to the status of system components or by querying coin status sensors, such as sensors 54-55. If the sorter is out of order the coin may, nevertheless, be fired and sent by default to a common bin (205) regardless of denomination. This allows continued operation of the system, while the malfunction is reported and remedial action may be taken.

If the sorter is operational, the denomination is checked in step 206 to see if the dispenser supports the currency, if not then it is sent to the common bin, if it is, the hopper capacity is checked in step 207 to determine if a bin can receive more coins. Again if the bin is full, then the coin is sent to the common bin, but if the bin is able to accept more coins, then the coin is directed to the appropriate bin for use as dispensing inventory in step 208.

The sorting step 208 involves the operation of the coin pocket 7 and striking solenoid 6. The initial position of the rack 9 aligns the ejector head 4 with the acceptor output and the ejector head 4 is returned to this position after each sorting cycle to receive the next coin. After a coin is accepted, and sorting is initiated, the ejector head 4 is first aligned with a default track to, if required, direct the coin to the common bin. If the sorter unit is functional, then a drive signal is generated by processor 53 based on the denomination identified by acceptor unit 1. The ejector head 4 is then moved to align with the proper track of the track module 5. The striker solenoid 6 is then fired to eject the coin out of coin pocket 7 and on to the aligned track of module 5. The force of the ejection is sufficient to carry the coin on the track to the destination bin.

In this manner a complete coin handling system is assembled having a horizontally oriented active sorting operation, that is compact, efficient, and accurate, while providing data to completely account for the inventory of loaded and recycled coins.

It should be understood that the above description is only illustrative of the invention. Various alternatives and modifications can be devised by those skilled in the art with out departing from the invention. Accordingly, the present invention is intended to embrace all such alternatives, modifications and variances which fall within the scope of the appended claims.

We claim:

1. A coin handling system, comprising:

a storage and dispensing unit having a series of bins each configured to receive coins and to store coins in bulk;

a sorter unit configured to receive coins and to distribute the coins to the bins of the storage and dispensing unit, the sorter unit further comprising:

a track module constructed to direct coins along a path to the bins of the storage and dispensing unit, the track module comprising a plurality of straight and parallel tracks, each track defining a substantially horizontal path and having a first end positioned to receive a coin from an ejector module and a second end positioned to deliver the coin into one of the series of bins; and the ejector module mounted to move along the first ends of the tracks into alignment with the first end of one of the tracks based on a denomination of a coin to be delivered to the bins, to receive coins from an acceptor unit and to forcibly propel coins out of the acceptor unit and along one of the substantially horizontal paths in the track module to cause the coins to travel into one of the bins.

2. The coin handling system of claim 1, wherein the acceptor unit is configured to receive coins, to validate the coins' authenticity, to identify a denomination of each coin, and to pass each coin from the ejector module to the first end of one of the tracks based on the denomination of the coin.

3. The coin handling system of claim 1, further comprising a controller unit configured to activate the ejector in response to an indication that a coin was received.

4. The coin handling system of claim 3, wherein the track module comprises an array of tracks, each track of the array providing a path to a bin associated with a particular coin denomination.

5. The coin handling system of claim 3, wherein each track comprises:

a coin rail extending towards the series of bins to provide a path to input openings constructed in each of the bins; and a series of gates constructed in the rail, each of the gates aligned with an opening of a particular bin associated with a specific coin denomination, wherein the ejector module is configured to forcibly eject a coin along the rail, and wherein the controller unit is configured to activate one of the gates to direct the ejected coin into one of the bins according to an identified denomination.

6. The coin handling system of claim 1, wherein the ejector module comprises:

a coin pocket constructed to provide a chamber for receiving coins from the acceptor unit; and an electrically actuated solenoid striker positioned operatively with respect to the coin pocket and configured to forcibly eject a coin from the chamber upon activation.

7. The coin handling system of claim 1, wherein the storage and dispensing unit comprises:

a chassis constructed to support the series of bins with each of the bins mounted on the chassis by means of a hinge and constructed to pivot on the hinge to permit dumping of bin contents while attached to the chassis.

8. The coin handling system of claim 7, wherein the chassis is slidably mounted in the coin handling system for movement between an operating position and a position in which the bins may be dumped.

9. The coin handling system of claim 1, wherein at least one of the bins is a default bin for receiving coins when the coin cannot be otherwise handled by the system.

10. The coin handling system of claim 3, further comprising a sensor positioned at the ejector to sense the receipt of a coin by the ejector to generate and send a signal to the controller indicating the receipt.

11. The coin handling system of claim 10, further comprising:

a bin full sensor operatively associated with each of the bins and configured to generate and send a signal to the controller indicating that a bin is filled to capacity.

12. The coin handling system of claim 11, further comprising:

a bin position sensor operatively associated with each of the bins to generate and send a signal to the controller indicating that the bin is in operational position.

13. The coin handling system of claim 4, wherein the ejector is moved by an alignment drive, the system further comprising:

a drive motor connected to the ejector module through a transmission and adapted to move the ejector module into alignment with a track; and a position encoder operatively associated with the ejector module and configured to generate and send a signal to the controller indicative of the position of the ejector module.

14. The coin handling system of claim 13, wherein the transmission is a rack and pinion and one of the rack and pinion is connected to the ejector module.

15. The coin handling system of claim 4, wherein the controller unit comprises:

a memory;

a sorter processor, and a program stored in the memory and executable by the sorter processor to move the ejector module into alignment with one of the tracks according to the denomination of a coin being handled.

16. The coin handling system of claim 5, wherein the controller unit comprises:

a memory;

a sorter processor, and a program stored in the memory and executable by the sorter processor to actuate one of the gates according to the denomination of a coin being handled.

17. The coin handling system of claim 9, wherein the controller unit comprises:

a memory;

a sorter processor, and a program stored in the memory and executable by the sorter processor to direct coins to the default bin when the coin cannot otherwise be handled by the system.

18. The coin handling system of claim 3, further comprising multiple sensors positioned in the system configured to generate signals indicative of the position of a coin in the system, at least one of the sensors configured to generate a signal indicative of: receipt of a coin by the ejector module, passage of a coin to a bin, and exit of a coin from the dispenser.

19. A coin sorter unit for a coin handling system, comprising:

multiple bins configured to receive and store coins by denomination;

an array of straight and parallel tracks, each track of the array defining a substantially horizontal path and having a first end at an ejector module and a second end at one of the bins;

an ejector module mounted for movement relative to the array of tracks into alignment with one of the tracks of the array; and a controller unit adapted to cause the ejector module to move into alignment with one of the tracks according to an identified coin denomination and to actuate the ejector module to propel a coin along the path provided by the aligned track.

20. A coin storage unit for a coin handling system, the coin storage unit comprising:

a plurality of bins arranged in two rows, each row comprising at least one bin, each bin configured to receive and store coins by denomination, each bin comprising a lid that covers an opening in the bin, the lid hinged for pivotal movement and having a coin slot, wherein the coin slot of each bin is aligned with one end of a different track in a track module, the track module having an array of straight and parallel tracks, each track of the array defining a substantially horizontal path and having a first end at an ejector module and a second end at the coin slot of one of the bins, the ejector module mounted for movement relative to the array of tracks into alignment with any one of the tracks of the array;

a support member below each row, each support member constructed to support each bin in the corresponding row, and wherein each bin in the corresponding row is mounted on the support member by a hinge and each bin is constructed to pivot on the hinge to permit dumping of the bin contents while attached to the support member, and wherein each bin pivots in a direction away from the other row; and a chassis configured to support each support member, the chassis configured to slidably mount within a host device.

* * * * *